United States Patent [19]

Kinkade

[11] Patent Number: 5,062,422

[45] Date of Patent: Nov. 5, 1991

[54] OFFSET ANATOMICAL MOUTHPIECE

[75] Inventor: Donald J. Kinkade, Greeley, Colo.

[73] Assignee: Kinkade Family Partnership, Greeley, Colo.

[21] Appl. No.: 449,560

[22] Filed: Dec. 12, 1989

Related U.S. Application Data

[63] Continuation-in-part of Ser. No. 283,611, Dec. 13, 1988.

[51] Int. Cl.[5] ..... A62B 9/06; B63C 11/16

[52] U.S. Cl. ..... 128/207.14; 128/201.11; 128/200.26

[58] Field of Search ..... 128/857, 859, 861, 862, 128/200.24, 200.26, 201.11, 201.26, 201.27, 206.29, 207.14, DIG. 26, 911, 912; 433/6, 215, 229

[56] References Cited

U.S. PATENT DOCUMENTS

| | | | |
|---|---|---|---|
| 1,302,004 | 4/1919 | Brown | 128/861 |
| 1,466,559 | 8/1923 | Purdy | 128/861 |
| 3,107,667 | 10/1963 | Moore | 128/861 |
| 3,250,272 | 5/1966 | Greenberg | 128/862 |
| 3,411,501 | 11/1968 | Greenberg | 128/862 |
| 4,031,888 | 6/1977 | Walters | 128/859 |
| 4,066,077 | 1/1978 | Shamlian | 128/201.11 |
| 4,230,106 | 10/1980 | Geslin et al. | 128/201.11 |
| 4,466,434 | 8/1984 | Brownstein | 128/207.14 |
| 4,664,109 | 5/1987 | Rasocha | 128/207.14 |
| 4,765,324 | 8/1988 | Lake, Jr. | 128/861 |

FOREIGN PATENT DOCUMENTS

| | | | |
|---|---|---|---|
| 0122878 | 10/1984 | European Pat. Off. | 128/859 |
| 422834 | 6/1947 | Italy | 128/207.14 |

*Primary Examiner*—Edgar S. Burr
*Assistant Examiner*—Kimberly L. Asher
*Attorney, Agent, or Firm*—David S. Woronoff

[57] ABSTRACT

A mouthpiece for use in diving or medical equipment, among others made of moldable resilient material having an offset between upper and lower jaw and a bite plane which is tapered with the bite place formed by wings which have varying thickness to create the taper.

8 Claims, 3 Drawing Sheets

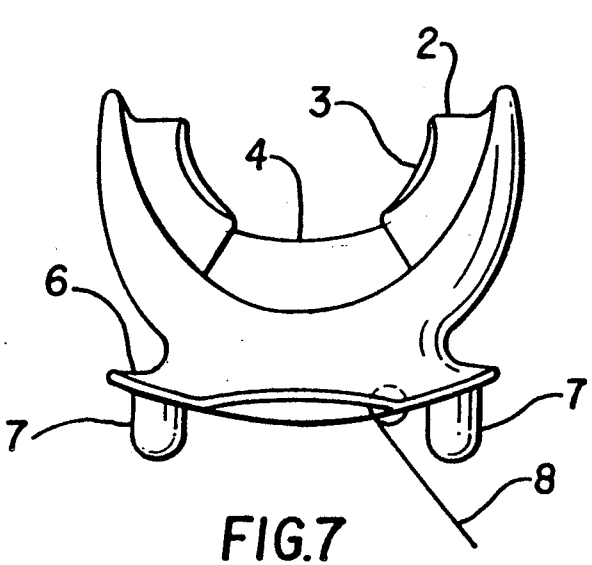
FIG.5
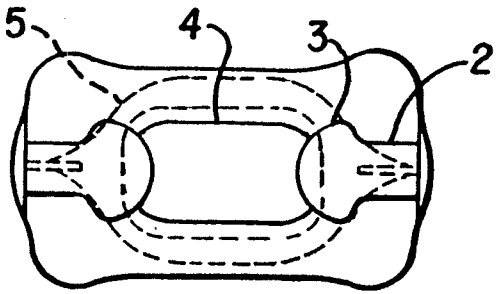
FIG.6
FIG.7
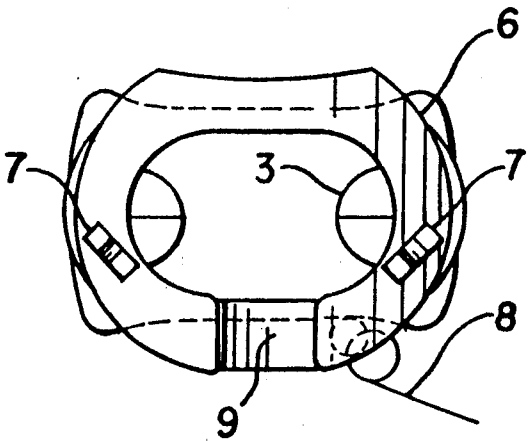
FIG.8

OFFSET ANATOMICAL MOUTHPIECE

This application is a continuation-in-part of application Ser. No. 07/283,611 filed Dec. 13, 1988 by the present inventor.

BACKGROUND OF THE INVENTION

1. Field of the Invention

The present invention relates to mouthpieces which are used in underwater breathing devices such as snorkels and regulators and to mouthpieces which are used in inhalators and gastric tubes for medical treatment.

2. Description of the Prior Art

The closest prior art known to applicant are U.S. Pat. Nos. 4,664,109, 4,466,434 and 4,136,689. Each patent shows a mouthpiece of the general type proposed by the present invention. U.S. Pat. No. 4,664,109 shows a mouthpiece which is symmetrical on its upper and lower surfaces with bite lugs which are of constant thickness and width. U.S. Pat. No. 4,466,109 shows an asymmetrical mouthpiece with an offset between the upper and lower surfaces. Bite lugs are shown which are of constant thickness and width and which are connected to each other by a ledge which firms the offset between the upper and lower surfaces to form a place for the upper front teeth to rest. The ledge thus formed is about 40 mm in width.

The prior art does not provide a device which the jaw structure shown in U.S. Pat. No. 4,466,434 is permitted to be in the normal mating bite position without continuing muscle tension. In particular the ball joint shown in FIG. 1 of the U.S. Pat. No. 4,466,434 is not kept in a normal rest position by any of the devices disclosed in the patents described above or by any other art known the applicant. In addition the prior art does not show an offset mouthpiece which is adaptable for both overbite and underbite conditions. The U.S. Pat. No. 4,466,434 device cannot be used with comfort in an underbite condition because of the ledge formed between the bite lugs.

SUMMARY

The present invention teaches a device with an offset between upper and lower jaw combined with tapered bite lugs and a particular bite pane which can be used by persons who require a mouthpiece such as divers and medical patients which mouthpiece does not distort the normal rest position of the jaw bones and jaw muscles including but not limited to the ball joint assembly in the jaw. The present invention teaches a device which can be used with comfort by persons who have either an overbite or an underbite condition.

BRIEF DESCRIPTION OF THE DRAWINGS

FIG. 8 is a rear view of the embodiment shown in FIG. 1.

FIGS. 5 and 6 are respectively top and rear views of a second embodiment of the present invention.

FIGS. 7 and 8 are top and front views of a third embodiment of the present invention.

DESCRIPTION

Figure 1:
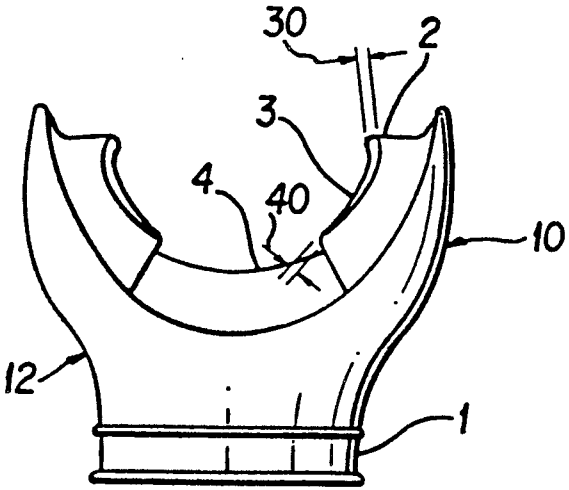
FIG. 1 shows a top view of one embodiment of the present invention.
Figure 2:
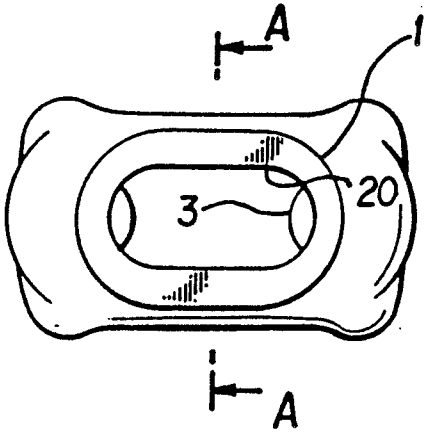
FIG. 2 shows a front view of the embodiment shown in FIG. 1.
Figure 9:
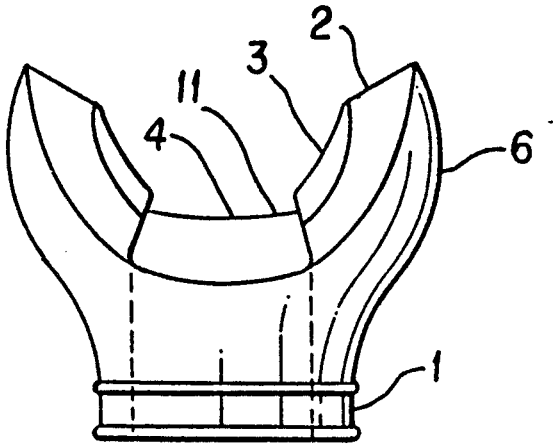
FIG. 9 is a the view of the embodiment shown in FIG. 1.
Figure 10:
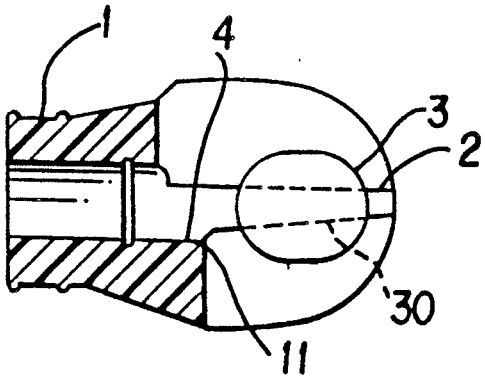
FIG. 10 is a front view of the embodiment shown in FIG. 9
Figure 12:
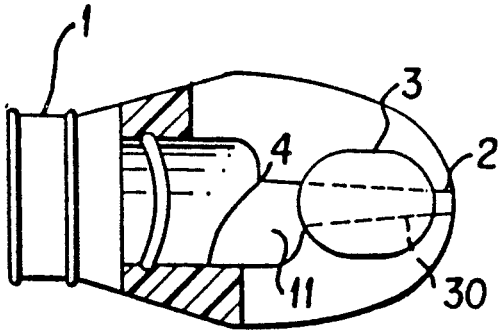
FIG. 12 is a view taken along the section line B—B shown in FIG. 11.
Figure 11:
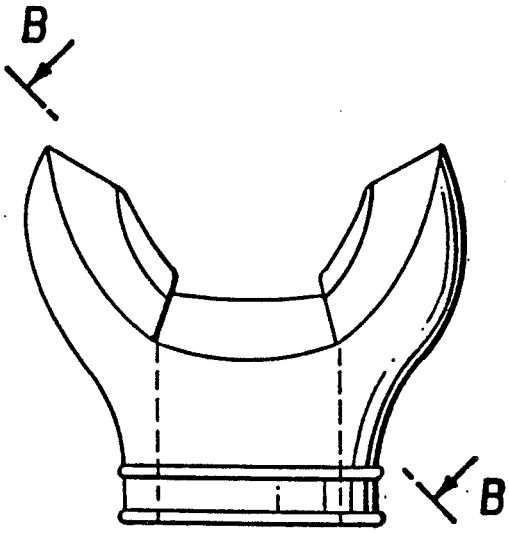
FIG. 11 is a view similar to FIG. 9 with the section lines B—B shown

FIG. 1 shows a top view of one embodiment 10 of the present invention formed of a moldable resilient material in which a standard coupling 1 is formed on one end. Numeral 12 shows generally the curvature of the mouthpiece 10. As shown in FIG. 2 the coupling has an orifice 20 to permit the passage of a gas. On the other end of the U shaped body 6 which is formed into two legs, internal wings, 3, are formed in either side of the generally U shaped body on the inside thereof. Numeral 2 shows the upper surface (in the drawing) of wings 3. The wings have a taper as shown by the different thickness dimensions 30 and 40 which are different by about 2 mm (1–4 mm). The internal wing members range from 6 to 12 mm in width, 14 to 40 mm in length and 2 to 8 mm in thickness and may be formed of a material which will conform to the shape of the user's teeth.

Figure 3:
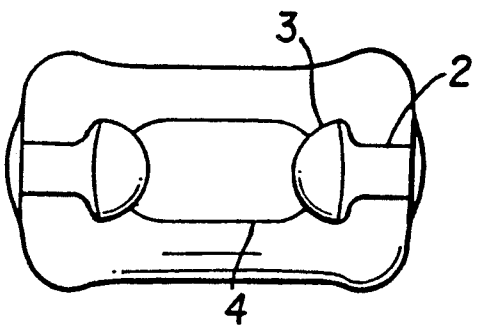
Figure 4:
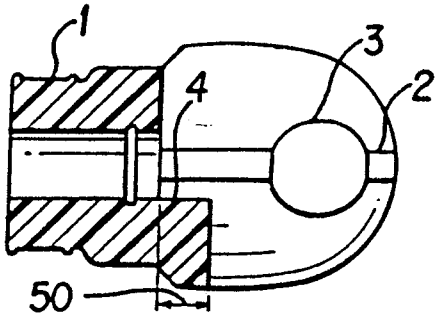
FIG. 4 is view partially in section taken along the lines A—A shown in FIG. 3.

FIG. 4 shows a side view partially in section in which the offset nature of the device is illustrated. A lip 4 is formed on what is shown in this drawing as the lower portion of the U shaped member. The width 50 of the lip ranges from about 1 to about 14 mm depending on the amount of overbite or underbite the user has. Because the lip only slightly exceeds the extent of the orifice 20 and does reach to the internal wings 3, the inventive device can be used by persons with either an overbite or underbite. The lip 4 reaches to the lower level of the wing 3 in a device oriented for use with an overbite. Naturally, if the device were oriented for use with an underbite the lip 50 would reach to the upper level of the wing 3. The curved portion 11 of the lip 50 reaches to the lower level of the wing 3 (in an overbite orientation). This structure is shown in detail in FIGS. 9 through 12. When the inventive mouthpiece is used in an underbite application, the curved portion 11 of the lip 4 reaches to the upper level of the wing 3.

While this structure is perhaps difficult to see in the drawings, it is well shown by the two models which were submitted with the parent application and which are still in the possession of the Patent Office. Those models and their structure are specifically incorporated by reference into this application. The lip 4 has a "U" shape with the vertical legs relatively short compared to the width of the bowl of the "U". This lip structure provides support from the incisors through to the bicuspids (eyeteeth).

FIGS. 5 and 6 show top and front view of a second embodiment of the present invention in which as stiffener 5 formed in the same general U shape is added to the body member 60 of the mouthpiece. The stiffener 5 may be formed of a rigid or slightly resilient material.

FIGS. 7 and 8 show top and front views of a third embodiment of the present invention. This embodiment is substantially identical with the first embodiment shown in FIGS. 1 through 4 except that clips 7 are attached to the mouthpiece 10 as shown in FIGS. 7 and 8. A line or lanyard 8 may be attached to the clips. The outer edge of the U shaped structure has a rolled edge 6 formed thereon as shown in FIGS. 7 and 8 to provide a convenient gripping surface for the clips 7. A channel or slot 9 may be formed in the upper or lower surface of the U shaped mouthpiece 10 to permit its removal without disconnecting any tubes which may be fitted for the user.

The present invention has been described with reference to particular embodiments. However those skilled in the art understand that many changes and modifications of those embodiments are possible which are within the scope of the present invention.

I claim:

1. A mouthpiece oriented for an overbite comprising:

U shaped body member having first and second ends and upper and lower portions;

the first end formed in a generally oval shape and having an orifice formed therein;

the second end extending away from the orifice and formed into two leg members, each having an outer end;

an internal wing member formed on each leg member near the outer end thereof;

the lower portion of the U shaped member extending outwardly toward the leg members more than the upper portion of the U shaped member to form an offset which reaches to the lowest level of the internal wing members;

the internal wing members having first and second ends;

said wing members have a taper such that the first end farther from the orifice is smaller than the second end nearer the orifice.

2. The mouthpiece claimed in claim 1 wherein the width of the offset ranges from 1 to 14 mm.

3. The mouthpiece claimed in claim 1 wherein the internal wing members are formed of material adapted to form to the bite of the user.

4. The mouthpiece claimed in claim 1 including further an internal stiffener formed in the U shaped member.

5. The mouthpiece claimed in claim 1 wherein:

the U shaped member has an outer edge formed into a rolled edge;

clip members attached to the rolled edge.

6. The mouthpiece claimed in claim 2 wherein a channel is formed through the U shaped member upper or lower portion, approximately perpendicular to the plane of the U shaped member, for permitting the removal of tubes without disconnect.

7. The mouthpiece claimed in claim 1 wherein the internal wing members have a range in size from 6 to 12 mm in width, from 14 to 40 mm in length and from 2 to 8 mm in thickness.

8. A mouthpiece comprising:

U shaped body member having first and second ends and upper and lower portions;

the first end formed in a generally oval shape and having an orifice formed therein;

the second end extending away from the orifice and formed into two leg members, each having an outer end;

a internal wing member formed on each leg member near the outer end thereof;

the internal wing members having first and second ends;

said wing members have a taper such that the first end farther from the orifice is smaller than the second end nearer the orifice.

* * * * *